US005544690A

United States Patent [19]

Magro et al.

[11] Patent Number: 5,544,690

[45] Date of Patent: Aug. 13, 1996

[54] ROLL-UP DOOR PROVIDED WITH THERMAL PROTECTION MEANS AND A DIRECT DRIVE GEARING ARRANGEMENT

[76] Inventors: Sebastian Magro, 22 Hallock Meadow Dr. North; Vincent Magro, 44 Melvern La., both of Stonybrook, N.Y. 11790

[21] Appl. No.: 240,573

[22] Filed: May 11, 1994

[51] Int. Cl.[6] ..... E06B 9/08

[52] U.S. Cl. ..... 160/133; 160/41; 160/23.1; 160/271

[58] Field of Search ..... 160/23.1, 35, 36, 160/40, 41, 133, 267.1, 268.1, 271, 310; 16/95 R, 96 R

[56] References Cited

U.S. PATENT DOCUMENTS

| | | | |
|---|---|---|---|
| 3,102,580 | 9/1963 | Greegor | 160/133 |
| 3,489,200 | 1/1970 | Recchione | 160/133 |
| 4,119,133 | 10/1978 | Wolf | 160/232 X |
| 4,234,033 | 11/1980 | Leivenson et al. | 160/133 |
| 4,467,853 | 8/1984 | Downey, Jr. | 160/133 |
| 5,246,053 | 9/1993 | Kraetler . | |
| 5,365,990 | 11/1994 | Ueda | 160/23.1 |

FOREIGN PATENT DOCUMENTS

| | | | |
|---|---|---|---|
| 765265 | 3/1934 | France | 160/23.1 |

*Primary Examiner*—Blair M. Johnson
*Attorney, Agent, or Firm*—Goodman & Teitelbaum, Esqs.

[57] ABSTRACT

A roll-up door including thermal protection devices provided in the mounting arrangement thereof to prevent the transfer of cold outside air, snow, ice and the like through the doorway covered by the roll-up door, the thermal protection devices including a plastic member in the mounting arrangement to provide a thermal break therein, heating members also disposed in the mounting arrangement, and a heated hood disposed over the support roller on which the door is rolled up into in the opened position thereof. The plastic member can have a snap-on construction to facilitate the assembling thereof, and also for the removal thereof in the event replacement is necessary. The roll-up door is provided with a direct drive gearing arrangement disposed between the motor gear of the roll-up and roll-down mechanism and the support roller gear to avoid the building up of forces therethrough usually caused when the support roller becomes fixed in place or difficult to rotate due to cold weather conditions. Preferably, the mounting arrangement also includes a wind bar and weather sealing fins to prevent outside wind, rain, snow and the like from passing therethrough into the doorway.

23 Claims, 5 Drawing Sheets

ROLL-UP DOOR PROVIDED WITH THERMAL PROTECTION MEANS AND A DIRECT DRIVE GEARING ARRANGEMENT

BACKGROUND OF THE INVENTION

This invention relates to a roll-up door and, more particularly, to a roll-up door having thermal protection means provided in the mounting arrangement of the side rails on opposite sides of the roll-up door, in which the roll-up door rides up and down during the raising and lowering thereof, and also provided by a heated hood arrangement disposed longitudinally over the support roller on which the roll-up door is rolled up into in the raised position thereof, the roll-up door also being provided with a direct drive gearing arrangement for the roll-up and roll-down mechanism, the direct drive gearing arrangement being disposed between the motor gear and the support roller gear to avoid the building up of forces therebetween.

Roll-up doors are well known in the door art. Usually, such roll-up doors include a series of adjoining slats which are hingedly interconnected so that the slats can pivot relative to each other when the door is raised and rolled onto a support roller. Opposite ends of the slats are disposed in side rails within vertically disposed tracks so that the slats can ride up and down when being raised and lowered. Generally, the only type of thermal protection provided in the prior art roll-up doors is in some form of insulation provided on the slats to prevent a heat loss therethrough. Such insulation is usually of the foam type which is sprayed or applied in block form to the slats. In many cases, the slats are formed with hollow recesses therein to receive such insulation.

The roll-up and roll-down prior art mechanism usually includes a conventional motor which drives a gear. The motor gear is usually connected by a drive chain to a gear provided on the support roller so that the motor can rotate the support roller when activated to either raise or lower the roll-up door. However, during cold weather conditions, the support roller can become fixed in place or difficult to rotate. The play in the drive chain, which connects the motor gear to the support roller gear, causes the forces between the support roller and the motor to build up when the support roller cannot be freely rotated, thus causing damage to the support roller and/or the motor and/or the gears therebetween.

Accordingly, there is presently a need for a roll-up door provided with thermal protection means disposed in the mounting arrangement on opposite sides of the roll-up door, additional thermal protection means provided for the support roller on which the roll-up door is rolled up upon, and also for a roll-up door provided with a direct drive gearing arrangement between the roll-up and roll-down mechanism of the roll-up door, particularly between the motor thereof and the support roller therefor.

SUMMARY OF THE INVENTION

It is accordingly an object of the present invention to provide a roll-up door which avoids the problems of the prior art roll-up doors.

Another object of the present invention is to provide a roll-up door that has thermal protection means to prevent the transfer of cold outside air, snow, ice and the like, through the doorway covered by the roll-up door.

Another object of the present invention is to provide a roll-up door in which the thermal protection means includes a plastic member provided in the mounting arrangements on opposite sides of the roll-up door to provide a thermal break therein, wherein the plastic member can have a snap-on construction.

Another object of the present invention is to provide a roll-up door in which the thermal protection means includes heating members disposed in the mounting arrangement of the roll-up door.

Another object of the present invention is to provide a roll-up door in which the mounting arrangement thereof includes a wind bar to prevent wind from passing therethrough, and also weather sealing fins to prevent wind, rain, snow and the like from passing therethrough.

A further object of the present invention is to provide a roll-up door, in which the thermal protection means includes a heated hood disposed over the support roller on which the door is rolled up into in the opened position.

A still further object of the present invention is to provide a roll-up door having a direct drive gearing arrangement for the roll-up and roll-down mechanism thereof.

Yet another object of the present invention is to provide a roll-up door in which the direct drive gearing arrangement is disposed between the motor gear and the support roller gear to avoid the building up of forces therebetween.

A further object of the present invention is to provide a roll-up door as described above that can be easily and mechanically manufactured and assembled at an effective cost to be reasonably priced.

Briefly, in accordance with the present invention, there is provided a roll-up door having thermal protection devices provided in the mounting arrangement thereof to prevent the transfer of cold outside air, snow, ice and the like, through the doorway covered by the roll-up door. The thermal protection devices include plastic members, which can have a snap-on construction, in the mounting arrangement thereof to provide a thermal break therein, heating members also disposed in the mounting arrangement, and a heated hood disposed over the support roller on which the door is rolled up into in the opened position. The roll-up door is provided with a direct drive gearing arrangement disposed between the motor gear of the roll-up and roll-down mechanism and the support roller gear to avoid the building up of forces therebetween, usually when the support roller becomes fixed in place or difficult to rotate due to cold weather conditions. Preferably, the mounting arrangement also includes a wind bar and weather sealing fins to prevent wind, rain, snow and the like from passing therethrough.

BRIEF DESCRIPTION OF THE DRAWINGS

With the above and additional objects and advantages in view, as will hereinafter appear, this invention comprises the devices, combinations and arrangements of the parts hereinafter described by way of example and illustrated in the accompanying drawings of preferred embodiments in which.

In the various figures of the drawings, like reference characters designate like parts.

DETAILED DESCRIPTION OF PREFERRED EMBODIMENTS

Figure 1:
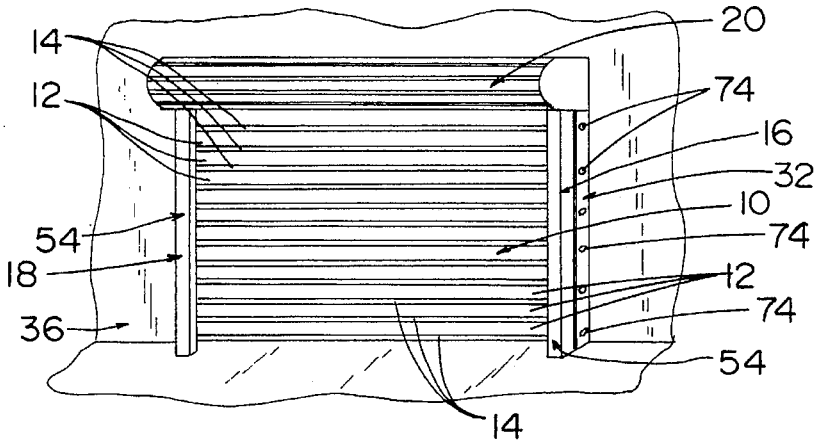
FIG. 1 is a fragmented perspective view illustrating a roll-up door provided with thermal protection means and a roll-up and roll-down mechanism having a direct drive gearing, arrangement in accordance with the present invention.

Referring now to the drawings, FIG. 1 shows a roll-up door 10 formed of a plurality of individual elongated slats 12 generally extending across the width of the door 10. The slats 12 are interconnected by a hinge arrangement 14 in a conventional manner well known in the art, so that the adjacent slats 12 are connected together in such a manner to permit pivotal movement therebetween. The opposite ends of the slats 12 are disposed in side rails 16, 18 in a protected arrangement within vertically disposed tracks, as set forth below in more detail, so that the slats 12 can ride up and down along the tracks. At the upper end of the doorway, there is a projecting header 20 which contains a support roller on which the door 10 is mounted, and a roll-up and roll-down mechanism for raising and lowering the door 10, where further details thereof will be discussed below.

Figure 2:
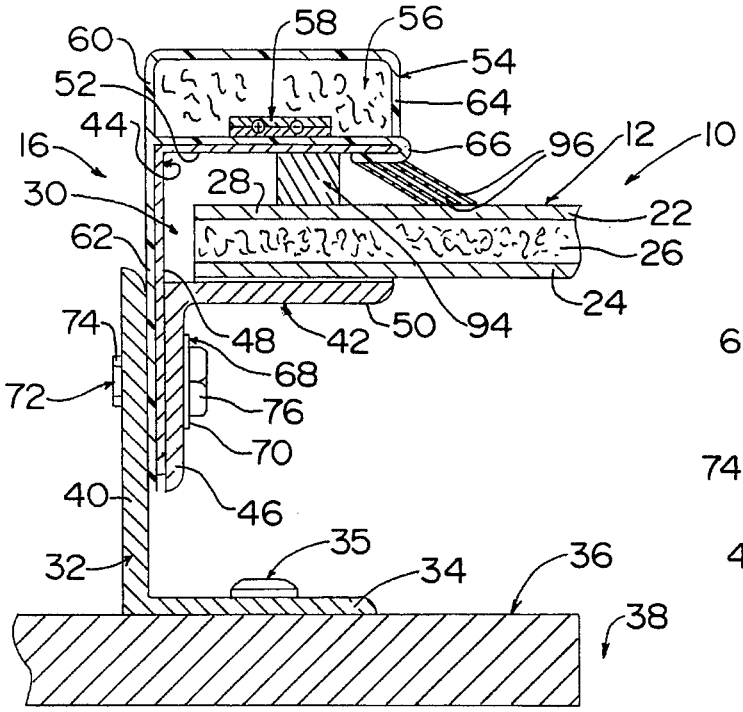
FIG. 2 is a fragmented top plan view, in cross section, showing the mounting arrangement on one side of the roll-up door.

FIG. 2 shows the mounting arrangement of the side rail 16, in cross-section, on one side of the door 10, where the mounting arrangement of the side rail 18 on the opposite side of the door 10 is the same and therefore a showing thereof is not thought necessary. Preferably, each slat 12 has a metal outside front member 22 and a metal inside back member 24, with insulation material 26 disposed therebetween to provide a thermal break between the inside and outside of the slat 12. It is noted, that the back member 24 can also be fabricated from a hard weather resilient plastic. The opposite end portions 28 of each slat 12 are disposed within an associated track 30 of the side rails 16 and 18, as set forth below.

The side rails 16, 18 each includes an L-shaped metal flange 32 having one vertical leg 34 secured, in a conventional manner well known in the art, such as by bolts 35, to the wall 36 adjacent one side of the doorway 38. The other vertical leg 40 of the flange 32 extends perpendicularly outwardly from the wall 36 for mounting other parts of the side rails 16, 18 thereon, as set forth below. The track 30 of each of the side rails 16, 18 is constructed by two metal L-shaped flanges 42, 44. The vertical leg 46 of the thicker flange 42 is disposed on the vertical leg 48 of the thinner flange 44 so that the other vertical leg 50 of the thicker flange 42 is positioned in a spaced apart arrangement from the other vertical leg 52 of the thinner flange 44 to provide a space therebetween forming the track 30 to receive the end portion 28 of the slat 12, as shown in FIG. 2.

An elongated plastic housing member 54, running the entire vertical length of each side rail 16, 18, is disposed on the outer side of the leg 52 of the thinner flange 44. The housing 54, which has a rectangular configuration, is filled with insulation 56, and also with a heating member 58, as will be discussed below. A vertical side wall 60 of the housing member 54 has an extended portion 62 which extends outwardly a substantial distance for connection to the flange 32, the extended portion 62 of the housing side wall 60 being disposed against the leg 48 of the thinner flange 44, the function of which being set forth below. Accordingly, the opposite vertical side wall 64 of the housing member 54 is provided with a hooked portion 66 which hooks around the vertical free end of the leg 52 of the thin flange 44 to secure the housing member 54 to the flange 44.

Figure 3:
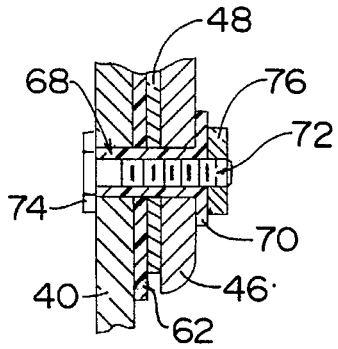
FIG. 3 is a fragmented cross sectional view showing the thermal break in the mounting arrangement of FIG. 2.

The leg 40 of the flange 32, the extended portion 62 of the housing side wall 60, the leg 48 of the flange 44 and the leg 46 of the flange 42 each have longitudinally spaced apart holes therethrough along the vertical length thereof. Accordingly, associated holes in the leg 40, the extended portion 62, the leg 48 and the leg 46 are aligned with each other, and a plastic sleeve 68 having an enlarged head 70 thereon is inserted into each of the aligned holes so that the sleeve head 70 is disposed against the inner surface of the leg 46, as best shown in FIG. 3.

A threaded bolt 72 is then inserted from the outside into each of the sleeves 68 so that the bolt head 74 is disposed against the outside surface of the leg 40, and the free end of the bolt 72 extends out of the sleeve 68 past the sleeve head 70. A nut or washer 76 is then threaded onto the free end of each of the bolts 72 so that the nut or washer 76 is tightened against the sleeve head 70, as shown in FIG. 3, to secure the housing 54, the flange 44 and the flange 42 to the flange 32, as shown in FIG. 2. Thus, the plastic extended portion 62 of the housing side wall 60 provides a thermal break between the outside leg 40 of the flange 32 and both the inside leg 48 of the flange 44 and the inside leg 46 of the flange 42. It is noted, that the plastic sleeve 68 also provides a thermal break between the outside bolt head 74 and both the inside leg 48 and the inside leg 46.

Figure 4:
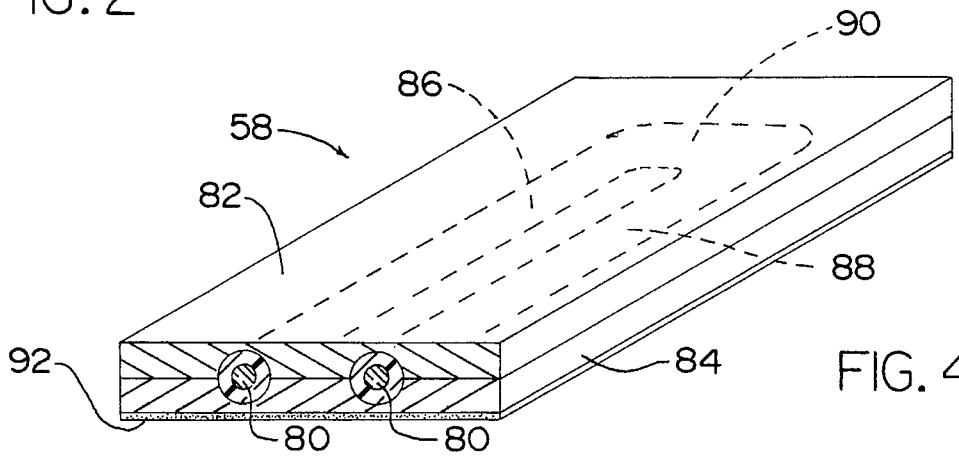
FIG. 4 is an enlarged perspective view, partly in cross section, of the heating element in the mounting arrangement of FIG. 2.

FIG. 4 shows an enlarged view of the heating member 58 which is disposed within the housing member 54. The heating member 58 includes an insulated electrical heating wire 80 which is sandwiched between two connected together vertically extending metal foils 82, 84 which conduct the heat therefrom. The electrical heating wire 80 is formed into a U-shaped construction to provide two straight spaced apart portions 86, 88 running longitudinally within the housing member 54 along the vertical length thereof, and a bight portion 90 connecting ends of the straight portions 86, 88 together at one end of the housing member 54. At the opposite end of the housing member 54, the free ends of the straight portions 86, 88 of the electrical heating wire 80 extend out from between the connected together metal foils 82, 84 for connection to an electrical power source. An adhesive 92 is provided on the outer surface of the metal foil 84 to secure the heating member 58 to an inner surface of the housing member 54 to securely maintain the position of the heating element 58 relative to the insulation 56 surrounding the heating member 58.

Accordingly, the insulation 56 in the housing member 54 functions to prevent the cold outside temperature from transferring into the track 30 of the side rails 16, 18. However, in extreme cold weather, the insulation 58 by itself is not sufficient. Accordingly, the heating member 58, when activated, heats the metal flange 44 so that the temperature within the track 30 is raised to a properly functioning temperature to enable the slats 12 to ride up and down within the track 30. Furthermore, in icy conditions, the heating member 58 melts any ice within the track 30 to enable the slats 12 to move freely within the track 30.

As shown in FIG. 2, the end portions 28 of the slats 12 are disposed against the leg 50 of the flange 42. Accordingly, an elongated vertically running steel wind bar 94 is secured along the longitudinal length of the leg 52 of the flange 44. The free inner surface of the steel wind bar 94 slidingly engages the end portions 28 of the slats 12 in such a manner to prevent the wind from passing therebetwen into the track 30. Additionally, elongated vertically extending plastic fins 96, preferably four, are secured to the inner surface of the hooked portion 66 of the housing wall 64 at an inclined position thereto so that the fins 96 extend in an outward inclined direction away from the free end of the hooked portion 66 toward the doorway 38. Here again, the free ends of the fins 96 are disposed against the slats 12 in a sliding engagement therewith to provide a weather seal to prevent wind, rain, snow and the like from entering into the track 30.

Figure 5:
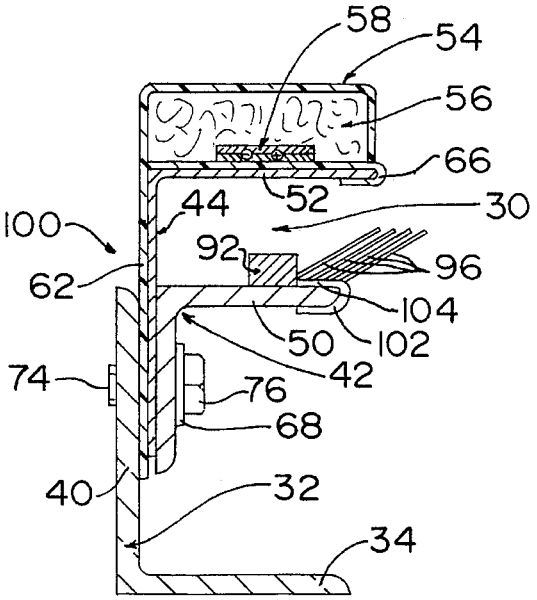
FIG. 5 is a top plan view, in cross section, showing a modified mounting arrangement for the roll-up door similar to the showing of FIG. 2.

FIG. 5 shows the mounting arrangement of a modified side rail 100, in cross section, which can also be mounted on opposite sides of the doorway 38 to receive the end portions 28 of the slats 12 in the tracks 30 thereof. In this embodiment, the outer surfaces of the end portions 28 of the slats 12 are slidingly disposed against the leg 52 of the flange 44 of each opposing side rail 100. Thus, the side rail 100 is substantially the same as the above mentioned side rail 16 except for the positioning of the steel wind bar 94, and also the elongated vertically extending plastic fins 96.

Accordingly, the steel wind bar 94 is secured along the longitudinal length of the leg 50 of the flange 42 so that the free outer surface of the steel wind bar 94 slidingly engages the end portion 28 of the slats 12 to prevent the wind from passing through the track 30 into the doorway 38. An enlongated vertically running C-shaped plastic clamp 102 is disposed around the free vertical end portion of the leg 50 along the longitudinal length of the leg 50 in a secured clamped arrangement. The free end of the outer leg 104 of the C-shaped clamp 102 is preferably disposed against the steel wind bar 94.

The C-shaped clamp 102 functions to secure the plastic fins 96 to the leg 50 of the flange 42. Accordingly, the plastic fins 96 are secured to the outer surface of the outer leg 104 of the C-shaped clamp 102 at an inclined position thereto so that the fins 96 extend in an outward inclined direction away from the free end of the leg 104 and outwardly from the track 30. Preferably, there are five fins 96, which are made longer to extend outwardly a greater distance from the outer surface of the steel wind bar 94 to provide an increased sliding engagement with the slats 12 to better prevent wind, rain, snow and the like from exiting from the track 30 into the doorway 38.

Figure 6:
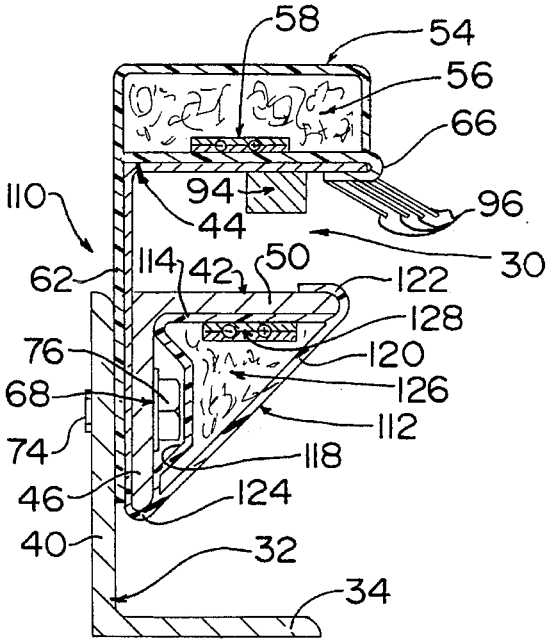
FIG. 6 is a top plan view, in cross section, showing a further modified mounting arrangement for the roll-up door similar to the showing of FIG. 2.

FIG. 6 shows the mounting arrangement of a further modified side rail 110, in cross section, which can also be mounted on opposite sides of the doorway 38 to receive the end portions 28 of the slats 12 in the tracks 30 thereof. This embodiment incorporates the same structure of the side rail 16, here the modification includes the addition of a second elongated plastic housing member 112 which runs the entire vertical length of the flange 42. The housing member 112 has a triangular cross section with one side wall 114 being disposed against the inner surface of the leg 50, and the other side wall 116 being disposed against the other leg 46.

The side wall 116 has either one vertical extending recess 118 or a series of vertically spaced apart recesses therein to receive the nuts or washers 36 therein. The base wall 120 extends from the free end of the leg 50 to the free end of the leg 46 of the flange 42. Accordingly, one end of the base wall 120 is also provided with a hooked portion 122 which hooks around the free end of the leg 50, and the opposite end of the base wall 112 is provided with a hooked portion 124 which hooks around the free end of the leg 46 to secure the housing member 112 to the flange 42.

The housing member 112 is filled with insulation 126, and also with a second heating member 128 disposed against the inner surface of the side wall 114 adjacent the leg 50. The heating member 128 is the same as the above-mentioned heating member 58, and functions in the same manner. Thus, the housing member 112 heats and prevents cold air, which may have entered into the track 30, from exiting from the track 30 into the doorway.

The above-mentioned housing member 54 is formed with the extended portion 62 thereof in a one piece integral construction so that the entire one piece integral construction must be removed from between the flanges 42, 44 for replacement thereof. The necessity of the replacement is usually due to damage of the plastic rectangular construction of the housing member 54 or to the heating member 58 disposed therein. Accordingly, FIG. 7 shows a modification which permits the housing member to be easily snapped on, and also removed in the event replacement thereof is necessary.

Figure 7:
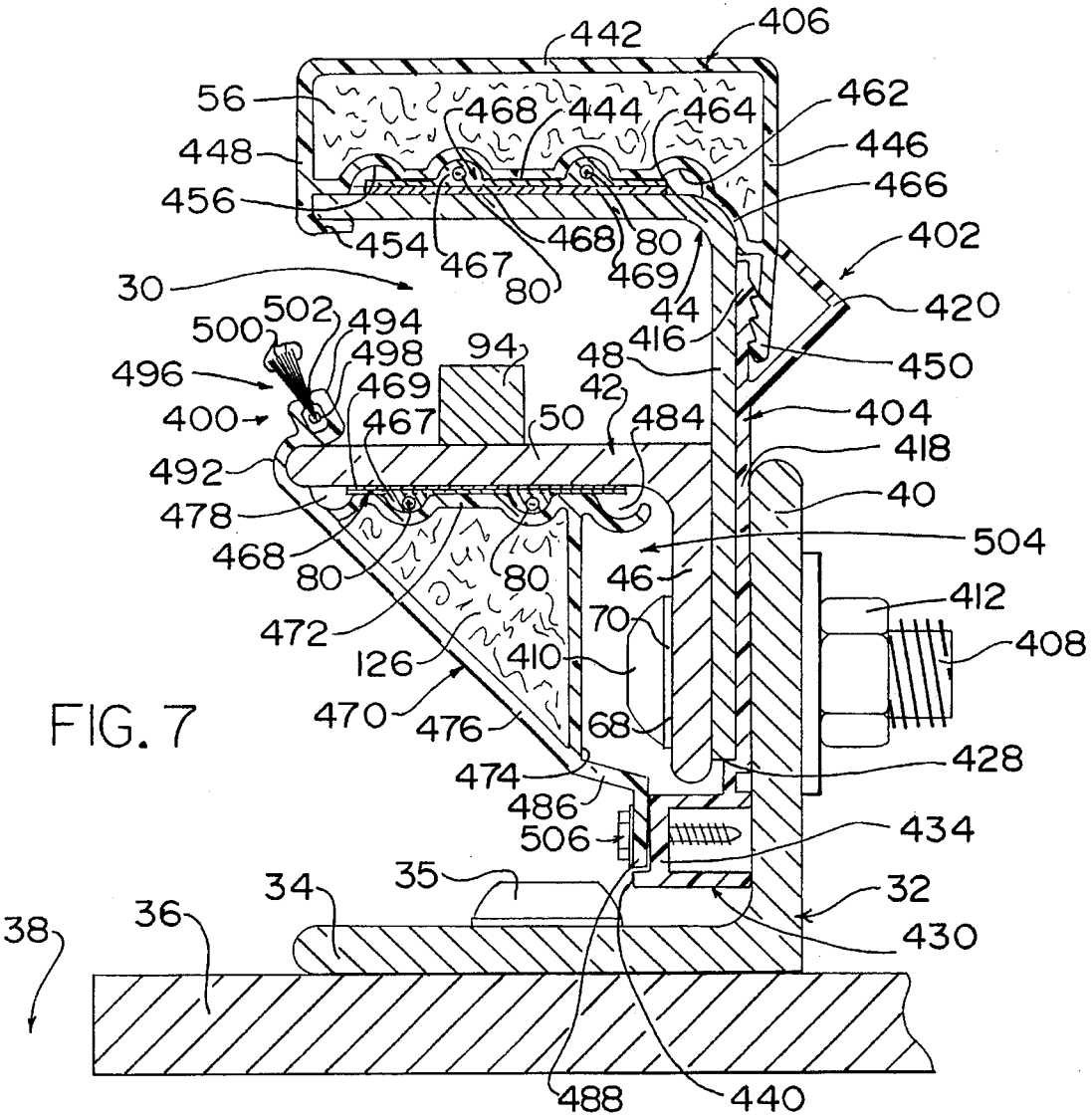
FIG. 7 is a top plan view, in cross section, showing another modified mounting arrangement disposed on the other side of the roll-up door, similar to the showing of FIG. 6.
Figure 9:
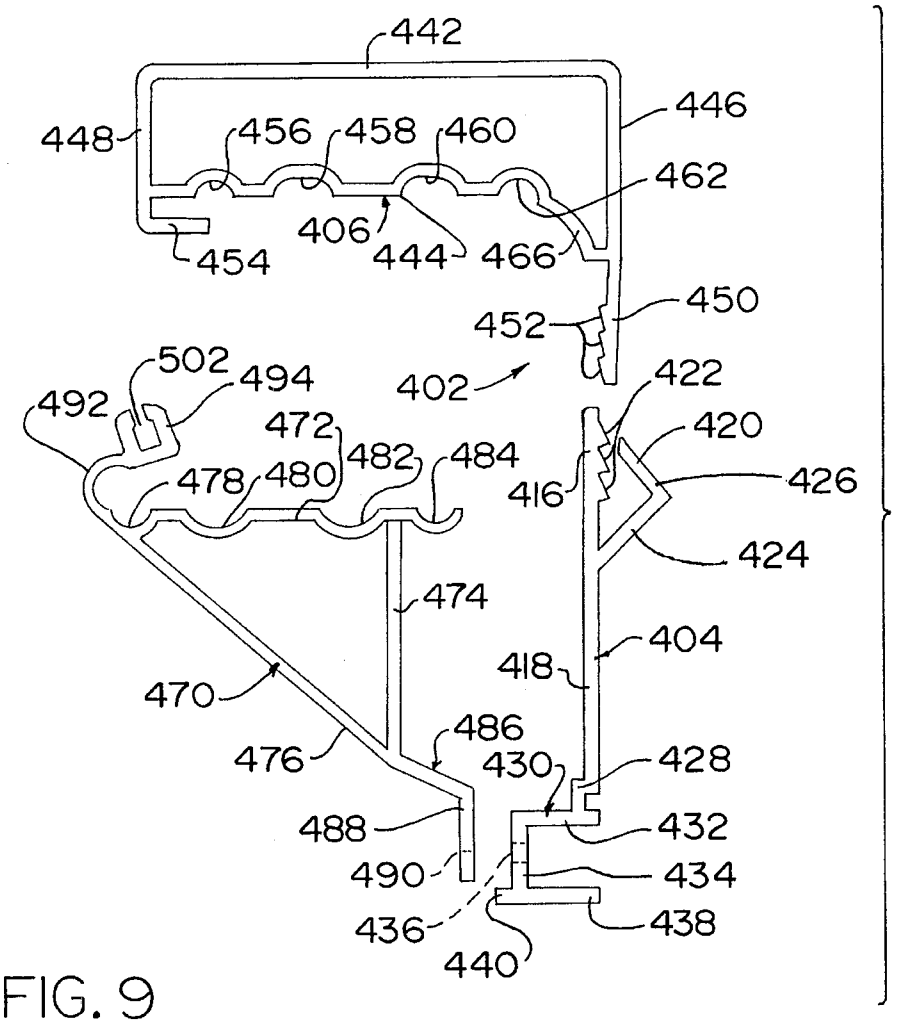
FIG. 9 is an exploded elevational view of the snap-on plastic housing member shown in FIG. 7.

Accordingly, FIG. 7 shows a mounting arrangement of another modified side rail 400, in cross section, which is disposed on the other side of the doorway 38, it being noted that the mounting arrangement on the opposite side thereof is the same and therefore a showing thereof is not necessary. In this arrangement, the housing member assembly 402 includes a vertically extending plastic female member 404 disposed between the flanges 32, 44, and a vertically extending plastic male member 406 having a hollow rectangular configuration to receive the insulation 56 therein, which rests against the leg 52 of the thinner flange 44. The female and male members of the housing member assembly are best shown in FIG. 9.

Figure 8:
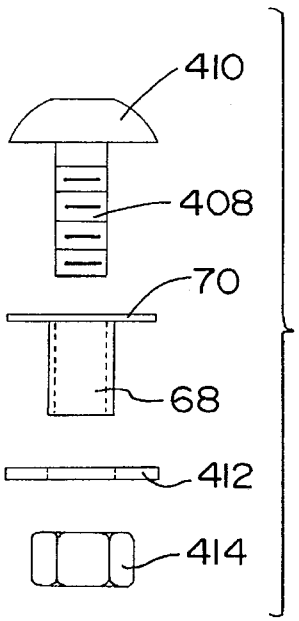
FIG. 8 is an exploded elevational view showing the securement means for the thermal break in the mounting arrangement of FIG. 7.

In the assembly of the side rail 400, after the flange 32 is secured to the wall 36 by the bolts 35, the associated holes in the leg 40, the female member 404, the leg 48 and the leg 46 are aligned with each other in the same manner as mentioned above, and the plastic sleeve 68 having the enlarged head 70 thereon, as best shown in FIG. 8, is inserted into each of the aligned holes so that the sleeve head 70 is disposed against the inner surface of the leg 46, in the same manner described above. In this arrangement, a threaded bolt 408 is then inserted from the inner side into each of the sleeves so that the bolt head 410 is disposed against the sleeve head 70, and the free end of the bolt 408 extends out of the sleeve 68 on the outside portion of the side rail 400.

A washer 412, preferably plastic, is then inserted onto the free end of the bolt 408, where the opening through the washer 412 is large enough to receive the sleeve 68 therein. It is noted, that any portion of the plastic sleeve 68, which extends outwardly from the washer 412, is cut off for obvious reasons. A nut 414 is then threaded onto the free end of each of the bolts 408, and the nut 414 is tightened against the washer 412, as shown in FIG. 7, to secure the plastic female member 404, the flange 44, and the flange 42 to the flange 32.

Thus, in the same manner as the above plastic extended portion 62 of the housing side wall 60, the plastic female member 404 provides a thermal break between the outside leg 40 of the flange 32 and both the inside leg 48 of the flange 44 and the inside leg 46 of the flange 42. It is noted, that here again, the plastic sleeve 68, as well as the plastic washer 412, provide a thermal break between the bolt 408 and the inside legs 46, 48, as well as with the nut 414.

As shown in FIGS. 7 and 9, one vertically outwardly extending end of the plastic female member 404 is bifurcated to provide a first free end finger portion 416 extending outwardly in line with the body portion 418 of the female member 404, and a second free end finger portion 420 extending in an off-set arrangement from the body portion 418. The inner surface of the finger portion 416 is provided with a series of vertically extending teeth 422 directed towards the body portion 418. The finger portion 420 has a V-shaped configuration, with one part 424 extending outwardly in an inclined direction from the body portion 418, and the other part 426 extending from part 424 inwardly in an inclined direction towards the finger portion 416 so that the free end of part 426 is spaced a predetermined distance from the finger portion 416 to provide an opening therebetween. It is noted, that the finger portion 420 is resilient, the function of which will be discussed below.

The other vertically inwardly extending end of the plastic female member 404 has a raised step to provide a stop portion 428, which abuts against the free end of the leg 48 of the flange 44, as shown in FIG. 7. An off-set U-shaped portion 430 extends outwardly from the stop portion 428, with one leg 432 being connected to the stop portion 428. The bight 434 has a hole 436 extending therethrough. The other leg 438 extends beyond the bight 436 to provide another stop portion 440. The functions of the above mentioned other vertically inwardly extending end of the female member 404 will be discussed in full detail below.

The hollow male member 406 includes an outside wall 442, an inside wall 444, an outer side 446 and an inner side 448 to form the hollow rectangular configuration. The outer side 446 extends inwardly beyond the inside wall 444 to provide a vertically extending finger portion 450. The inner surface of the finger portion 450 is provided with a series of vertically extending teeth 452 directed towards the inner side wall 444, the function of which will be explained below. The inner side 448 also extends inwardly beyond the inner side wall 444 to provide a resilient hooked portion 454 which is similar to and functions in the same manner as the above mentioned hooked portion 66 of the housing member 54, as will be discussed below.

The inside wall 444 is curved in a corrugated-like manner to provide a series of recesses 456, 458, 460 and 462, the function of which will be explained below. Additionally, a curved abutment portion 466 is provided between the recess 462 and the finger portion 450, as will also be explained below.

As shown in FIG. 7, the male member 406 is preferably, but not necessarily, provided with a heating member 468 which is basically the same as the above mentioned heating member 58, and functions in the same manner. However, as will be desribed below, the construction of the two metal foils 467 and 469 has been modified to a thinner construction so that the metal foil 467 conforms to the curved shape of the heating wire 80 to form vertically extending spaced apart ribs for engagement in the above mentioned recesses 458 and 460 of the inside wall 444 of the male member 406, described below.

When assembling the male member 406, the ribs formed by the metal foil 467 are positioned in the recesses 458 and 460, as indicated above. Thereafter, the opposite two recesses 456 and 462 are filled with conventional caulking (not shown) so that the caulking secures the heating member 468 to the inner side wall 444, where the caulking also insulates the heating member 468 for better heat conduction. It is noted, that the insulation 56 can be inserted into the hollow rectangular construction of the male member 406 before or after the heating member 468 is positioned.

The outside and inside walls 442, 444 are now inclined relative to the leg 52 of the thinner flange 44, and the resilient hooked portion 454 is hooked onto the free end of the leg 52. Thereafter, the outside and inside walls 442, 444 are pivoted towards the leg 52, and the finger portion 450 of the male member 406 is inserted into the opening between the finger portions 416, 420 of the female mameber 404, which may require the finger portion 420 being pulled away from the finger portion 416 and/or the finger portion 450 being resiliently bent to permit the entry of the finger portion 450.

The abutment portion 466 of the male member 406 is then pushed against the corner portion 464 of the flange 44 so that the teeth 452 of the finger portion 450 snap into engagement with the teeth 422 of the finger portion 416 to secure the male member 406 to the female member 404 in a snap-on arrangement. Thus, as shown in FIG. 7, the male member 406 is now removably secured on the flange 44, which enagement is enhanced by the caulking, which is disposed in the recesses 456, 462, being also engaged against the surface of the leg 52 of the thinner flange 44.

Preferably, as shown in FIG. 7, the side rail 400 also includes the addition of an elongated plastic housing member 470 which runs the entire vertical length of the flange 42. The housing member 470 has a triangular cross section, similar to the housing member 112 shown in FIG. 6, with the side wall 472 being disposed adjacent to the inner surface of the leg 50, the side wall 474 being disposed adjacent the other leg 46, and the base wall 476 being inclined between the ends of the side walls 472, 474. It is noted, in this embodiment, that the steel wind bar 94 is secured along the longitudinal length of the leg 50, in the same manner and for the same function as the steel wind bar 94 shown in FIG. 5.

The side wall 474 and the base wall 476 preferably have a straight and flat configuration, where the side wall 472 is curved in a corrugated-like manner to provide a series of recesses 478, 480,482 and 484, where the recess 484 extends beyond the side wall 474 as shown in FIG. 9, the function of which will be explained below. An off-set leg portion 486 extends from the apex joining the side wall 474 and the base wall 476 to provide a vertically extending free leg 488 having a series of vertically spaced apart holes 490 therethrough, as will be explained below. Accordingly, the opposite apex joining the side wall 472 and the base wall 476 is provided with a vertically and outwardly extending vertical curved hooked portion 492 having a vertically extending U-shaped receptacle portion 494 on the free end thereof, as will also be explained below.

In this embodiment, as shown in FIG. 7, the above mentioned plastic fins 96 have been modified to provide a vertically extending fin insert 496. The fin insert 496 includes a vertically extending plastic rib 498 having vertically extending plastic fins 500 thereon, the fins 500 extending outwardly from one vertical side thereof. Accordingly, the rib 498 is snapped through the opening 502 between the legs of the U-shaped receptacle portion 494, and is retained within the receptacle portion 494 so that the fins 500 extend outwardly therefrom as shown in FIG. 7. The fins 500 function in the same manner as the above mentioned fins 96 shown in FIG. 5.

The housing member 470 is secured to the flange 42 after the above mentioned securement of the female member 404. Accordingly, when assembling the housing member 470, another heating member 468 is preferably, but not necessarily, associated therewith. Thus, in a manner similar to the above mentioned assembly, the ribs formed by the metal foil 467 of the second heating member 468 are positioned in the recesses 480 and 482. Thereafter, the opposite two recesses 478 and 484 are filled with the conventional caulking (not shown) so that the caulking secures the second heating member 468 to the side wall 472. Here again, it is noted, that the insulation 126 can be introduced into the hollow triangular construction of the housing member 470 before or after the second heating member 468 is positioned.

The hooked portion 492 is now hooked onto the free end of the leg 50 of the flange 42 so that the fins 500 project into the track 30, as shown in FIG. 7. It is noted, that when the housing member 470 is hooked on the leg 50, the extending portion of the recess 484 and the off-set leg portion 486 provide a recess 504 for the bolt heads 410 of the bolts 408, as shown in FIG. 7. The leg 488 is now positioned adjacent to the bight 434 of the U-shaped portion 430, and the respective holes 490, 436 are aligned with each other. A self tapping screw is now inserted through each hole 490 in the leg 488, and then is self tapped through each hole 436 in the bight 434 to removably secure the housing member 470 to the female member 404, where the securement is enhanced by the caulking as indicated above.

Thus, as indicated above, the housing member assembly 402 and the housing member 470 can be easily secured to, and also removed from the side rail 400 in the event replacement thereof is necessary. Thus, the housing member assembly 402 and the housing member 470 heat and prevent cold air which may have come into the track 30, from exiting from the track 30 into the doorway 38.

As mentioned above, the side rails 16, 100, 110 and 400 provide thermal protection for the door 10 when in the closed position. However, there is a need for thermal protection of the door 10 when in the rolled up position, or when being rolled up or down, to enable the door 10 to freely roll up onto and roll down from the conventional support roller on which the door 10 is mounted. This thermal protection is provided by a hood arrangement as set forth below.

Figure 10:
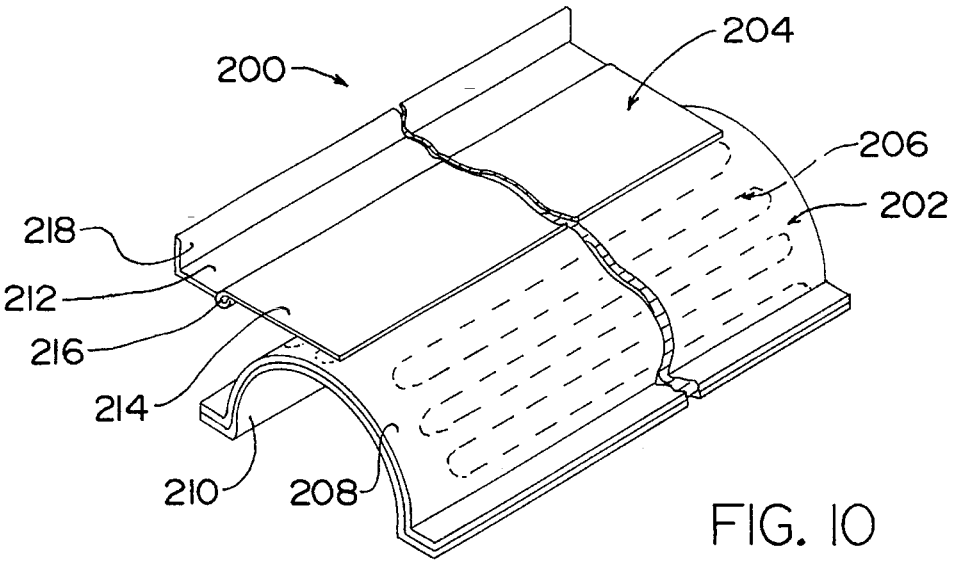
FIG. 10 is a perspective view of a heated hood arrangement for the roll-up door when disposed on the support roller.

FIG. 10 shows a heated hood arrangement 200 including a heated hood 202 connected to a hinged bracket member 204. It is noted, that the heated hood arrangement 200 is disposed within the header 20 above the door 10, extending in a horizontal direction therein. The heated hood 202 is disposed above the support roller so that the heated hood 202 freely rests on the support roller to permit vertical movement of the heated hood 202 relative to the support roller, as set forth below.

The heated hood 202 is similar to the above-mentioned heating members 58, 128, 468 in that the heated hood includes an insulated electrical heating wire 206 which is sandwiched between two longitudinally extending metal foils 208, 210. The metal foils 208, 210 are secured together and transversely curved to substantially form a semi-circular construction which is bowed upwardly. The electrical heating wire 206 has a serpentine configuration to adequately heat the entire area between the metal foils 208, 210, where the metal foils 208, 210 conduct the heat from the electric heating wire 206 outwardly from the heating hood 202. The free ends of the electric heating wire 206 extend out from between the connected together metal foils 208, 210 for connection to an electric power source, in a conventional manner well known in the art.

The bracket member 204 includes two horizontally extending panel portions 212, 214 which are hinged together along the longitudinal lengths thereof by hinge means 216, such as by curvingly bending the longitudinal end of the panel portion 214 within the curvingly bent longitudinal end of the panel portion 212 so that the panel portion 214 can pivot relative to the panel portion 212. The opposite longitudinal end of the panel portion 214 is secured to the longitudinal center of the heated hood 202 on the upper surface thereof by conventional suitable connecting means, such as by welding, screws, rivets, bolts and the like, so that the heated hood 202 is fixedly secured to the panel portion 214 for movement therewith. The opposite longitudinal end of the panel portion 212 is bent upwardly, preferably at a right angle, to form a flange 218. The flange 218 is fixedly secured by conventional means, such as rivets, screws, bolts and the like, to a horizontal portion of the wall 36 disposed above the doorway 38 within the header 20 so that the heated hood 202 is horizontally disposed in the header 20 above the doorway 38.

Figure 11:
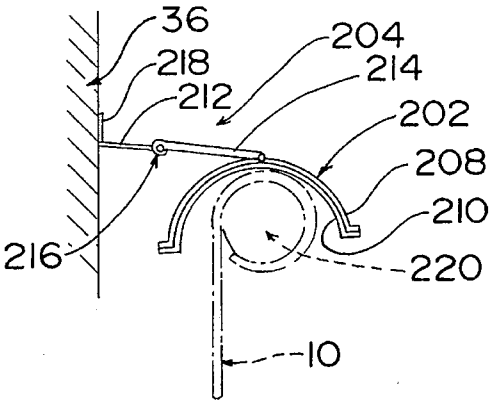
FIG. 11 is an end view of the heated hood arrangement, showing the position thereof when the roll-up door is unrolled from the support roller.

As shown in FIG. 11, the heated hood 202 is resting on the top portion of the door 10 which is secured around the support roller 220, shown in phantom lines. Thus, the heated hood 202 heats the upper portion of the door 10 and the support roller 220 so that these parts are free to rotate when it is desired to roll up the door 10.

Figure 12:
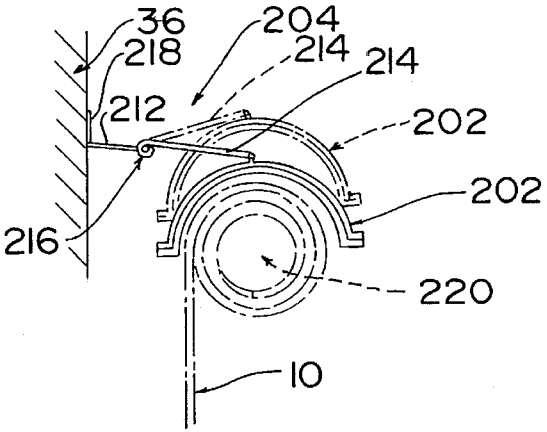
FIG. 12 is an end view of the heated hood arrangement, showing the position thereof when the roll-up door is being rolled up on the support roller.

As shown in FIG. 12, the door 10 is being rolled up on the support roller 220, shown in phantom lines, so that the heated hood 202 is raised in a vertical direction as more and more of the door 10 is rolled up on the support roller 220. Accordingly, as indicated in phantom lines, as the heated hood 202 moves up in the vertical direction, the panel portion 214 pivots about the panel portion 212 of the bracket member 204 until the door 10 is fully rolled up on the support roller 220. Thus, the heated hood 212 heats the door 10 as it is being rolled up, and continues to heat the door 10 when it is fully rolled up on the support roller 220 so that the door 10 and the support roller 220 are free to rotate when it is desired to lower the door 10.

Figure 13:
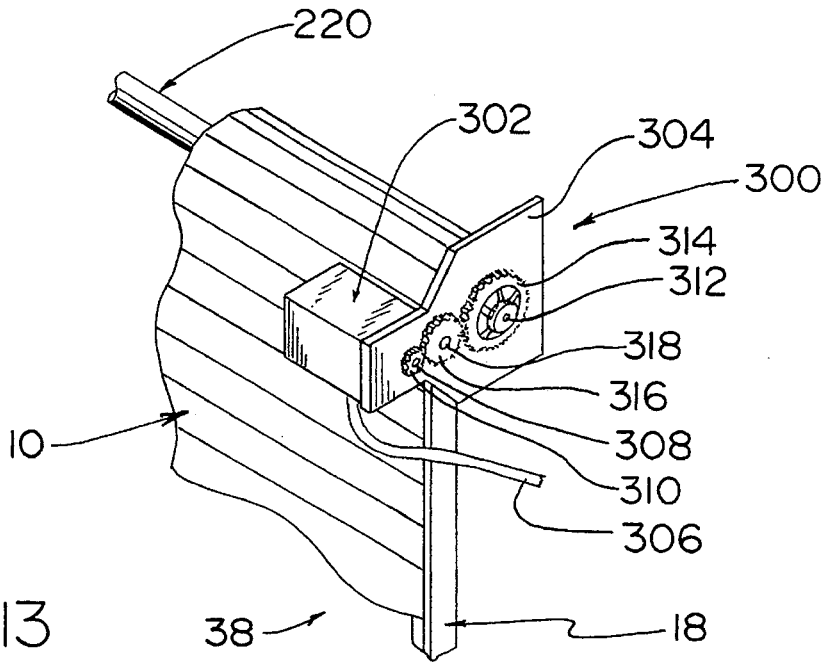
FIG. 13 is a fragmented perspective view showing the roll up and roll-down mechanism on one end of the rolling door.

FIG. 13 shows the roll-up and roll-down mechanism 300, which is disposed inside the doorway 38 on one side of the door 10, for rotating the support roller 220 to raise and lower the door 10. It is noted, that during cold weather conditions particularly during icy conditions, the support roller 220 can become fixed in place or difficult to rotate, thus causing damage to the support roller and/or the motor, and/or the gears therebetween. The main cause of this damage is the prior art drive chain which connects the motor gear to the support roller gear in that the drive chain has play therein which causes the forces between the support roller and the motor to build up when the support roller cannot be freely rotated.

Accordingly, the roll up and roll down mechanism 300, includes a motor box 302 having a conventional motor therein mounted on a one piece mounting plate 304, where the motor is connected to an electric power source by an electrical cord 306. The mounting plate 304 is secured to the wall 36 in a conventional manner. The motor shaft 308 extends freely through a hole in the mounting plate 304, and a small gear 310 is fixedly secured thereon. An end shaft 312 of the support roller 220 also extends freely through a hole in the mounting plate 304, and a large gear 314 is fixedly secured thereon. The small motor gear 310 is horizontally spaced from the large support roller gear 314 a predetermined distance.

Figure 14:
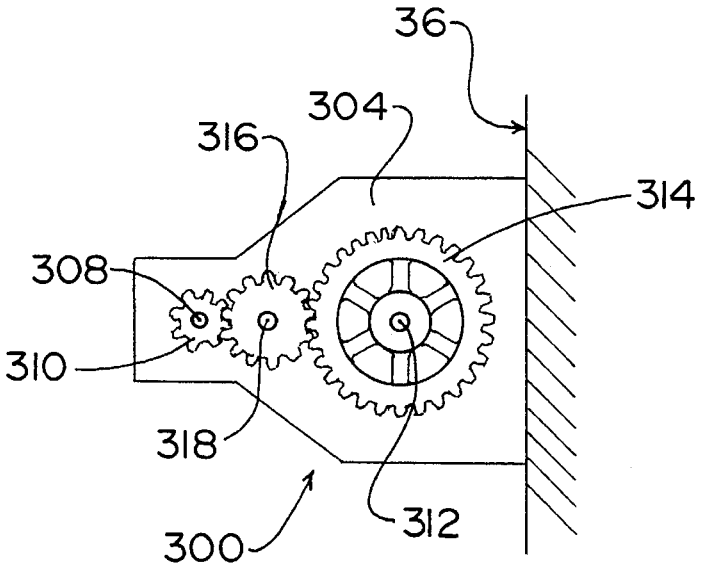
FIG. 14 is an enlarged end elevational view showing the direct drive gearing arrangement of the roll up and roll-down mechanism of FIG. 13.

Normally, according to the prior art, a drive chain would be mounted on the small motor gear 310 and on the large support roller gear 314 so that the motor can rotate the support roller 220. However, to avoid the above mentioned problems, an intermediate gear 316 is rotatably mounted on the mounting plate 304 by means of a shaft 318. The gear 316 is disposed between the small motor gear 310 and the large support roller gear 314 so that the teeth of the intermediate gear 316 engages the teeth of both the small motor gear 310 and the large support roller gear 314. Accordingly, the small motor gear 310 turns the gear 316, which in turn rotates the large support roller gear 314. It is noted, that the motor shaft 308, the intermediate gear shaft 318 and the support roller shaft 312 are in a straight horizontal alignment with each other, as best shown in FIG. 14.

Thus, the intermediate gear 316 provides for a direct drive gearing arrangement between the motor and the support roller 220 so that there is no play therebetween, as mentioned above with respect to the prior art drive chain. Therefore, the forces between the motor and the support roller 220 do not build up and cause the damage mentioned above.

Numerous alterations of the structures herein disclosed will suggest themselves to those skilled in the art. However, it is understood that the present disclosure relates to preferred embodiments of the invention which are for the purposes of illustration only, and are not to be construed as limitations of the invention.

What is claimed is:

1. A roll-up door comprising:

a plurality of elongated slats extending in a horizontal direction, said slats being disposed one above the other to provide said door;

hinge means connecting longitudinal edges of adjacent ones of said slats together to provide pivotal movement therebetween;

spaced apart side rails being disposed in a vertical direction to provide a vertically disposed track in each of said side rails for receiving opposite ends of said slats therein so that said slats can ride up and down along each track;

a horizontally disposed support roller being positioned between upper portions of said side rails for rolling up said slats thereon into a raised opened position;

a roll-up and roll-down mechanism coacting with said support roller for raising and lowering said slats;

thermal protection means being provided in said side rails to prevent cold outside temperature from transferring through said side rails and into a doorway covered by said slats when said slats are in a lowered closed position;

each of said side rails including a vertical metal first flange having a second leg secured to a wall adjacent one associated side of the doorway;

vertical metal second and third flanges having associated first legs secured to a first leg of said first flange, and associated second legs of said second and third flanges being horizontally spaced apart to provide said track;

said thermal protection means including a vertically extending plastic member disposed between said first leg of said first flange on one side thereof and said first legs of said second and third flanges on an opposite side thereof to provide a thermal break therebetween; and said first, second and third flanges and said plastic member being secured together by bolts extending therethrough and nuts fastened on said bolts, each of said bolts being provided with a plastic sleeve to provide a thermal break between an outside portion of said bolt and inside portions of said second and third flanges.

2. A roll-up door according to claim 1, wherein wind bar means are vertically disposed in said track for slidingly engaging said slats for preventing wind from passing therebetween.

3. A roll-up door according to claim 1, wherein resilient fin means are vertically disposed in said track for slidingly engaging said slats to provide a weather seal for preventing wind, rain and snow from entering into said track.

4. A roll-up door according to claim 1, wherein a hood arrangement is disposed longitudinally over said support roller, said hood arrangement including electrical heating means for heating said slats when rolled up on said support roller.

5. A roll-up door according to claim 1, wherein a direct drive gearing arrangement is provided between said support roller and said roll-up and roll-down mechanism to prevent forces from building up therebetween, said direct drive gearing arrangement including a large gear disposed on said support roller, a small gear disposed on said roll-up and roll-down mechanism, and an intermediate gear engagingly disposed between said small gear and said large gear for rotation therebetween.

6. A roll-up door comprising:

a plurality of elongated slats extending in a horizontal direction, said slats being disposed one above the other to provide said door;

hinge means connecting longitudinal edges of adjacent ones of said slats together to provide pivotal movement therebetween;

spaced apart side rails being disposed in a vertical direction to provide a vertically disposed track in each of said side rails for receiving opposite ends of said slats therein so that said slats can ride up and down along each track;

a horizontally disposed support roller being positioned between upper portions of said side rails for rolling up said slats thereon into a raised opened position;

a roll-up and roll-down mechanism coacting with said support roller for raising and lowering said slats;

thermal protection means being provided in said side rails to prevent cold outside temperature from transferring through said side rails and into a doorway covered by said slats when said slats are in a lowered closed position;

each of said side rails including a vertical metal first flange having a second leg secured to a wall adjacent one associated side of the doorway;

vertical metal second and third flanges having associated first legs secured to a first leg of said first flange, and associated second legs of said second and third flanges being horizontally spaced apart to provide said track;

said thermal protection means including a vertically extending plastic member disposed between said first leg of said first flange on one side thereof and said first legs of said second and third flanges on an opposite side thereof to provide a thermal break therebetween; and said second leg of said third flange being disposed between said second leg of said second flange and the wall, said plastic member being connected to a vertically extending plastic hollow housing, said hollow housing being disposed vertically along an outer side of said second leg of said second flange for insulation thereof.

7. A roll-up door according to claim 6, wherein said thermal protection means also heats said slats when said slats are rolled up on said support roller.

8. A roll-up door according to claim 6, wherein a direct drive gearing arrangement is provided between said support roller and said roll-up and roll-down mechanism to prevent forces from building up therebetween, said direct drive gearing arrangement including a first gear disposed on said support roller, a second gear disposed on said roll-up and roll-down mechanism, and a third gear engagingly disposed between said first gear and said second gear for rotation therebetween so that said second gear turns said third gear, and said third gear turns said first gear.

9. A roll-up door according to claim 6, wherein said hollow housing is filled with insulation material.

10. A roll-up door according to claim 6, wherein electrical heating means are provided in said hollow housing adjacent to said second leg of said second flange for heating said track so that said slats can freely ride up and down within said track.

11. A roll-up door according to claim 6, wherein a side wall of said hollow housing has a series of recesses therein, and electrical heating means being provided in said recesses against said second leg of said second flange for heating said track so that said slats can freely ride up and down within said track.

12. A roll-up door according to claim 6, wherein said plastic member and said plastic hollow housing are connected together as a one piece integral unit.

13. A roll-up door according to claim 6, wherein releaseable securement means connect said plastic member and said plastic hollow housing together in a snap-on construction to facilitate assembling thereof, and for removal thereof for replacement thereof.

14. A roll-up door according to claim 13, wherein said releaseable securement means includes one end of said plastic member being bifurcated a to provide a pair of finger portions to receive therebetween a finger portion provided on said plastic hollow housing, and teeth means for releaseably securing said pair of finger portions of said plastic member and said finger portion of said plastic hollow housing together.

15. A roll-up door comprising:

a plurality of elongated slats extending in a horizontal direction, said slats being disposed one above the other to provide said door;

hinge means connecting longitudinal edges of adjacent ones of said slats together to provide pivotal movement therebetween;

spaced apart side rails being disposed in a vertical direction to provide a vertically disposed track in each of said side rails for receiving opposite ends of said slats therein so that said slats can ride up and down along each track;

a horizontally disposed support roller being positioned between upper portions of said side rails for rolling up said slats thereon into a raised opened position;

a roll-up and roll-down mechanism coacting with said support roller for raising and lowering said slats;

thermal protection means being provided in said side rails to prevent cold outside temperature from transferring through said side rails and into a doorway covered by said slats when said slats are in a lowered closed position;

each of said side rails including a vertical metal first flange having a second leg secured to a wall adjacent one associated side of the doorway;

vertical metal second and third flanges having associated first legs secured to a first leg of said first flange, and associated second legs of said second and third flanges being horizontally spaced apart to provide said track;

said thermal protection means including a vertically extending plastic member disposed between said first leg of said first flange on one side thereof and said first legs of said second and third flanges on an opposite side thereof to provide a thermal break therebetween;

said second leg of said third flange being disposed between said second leg of said second flange and the wall;

said plastic member being connected to a vertically extending plastic hollow first housing, said first housing being disposed vertically along an outer side of said second leg of said second flange for insulation thereof; and a vertically extending plastic hollow second housing being disposed vertically between said first and second legs of said third flange for insulation thereof.

16. A roll-up door according to claim 15, wherein releaseable securing means connect said second housing to said plastic member.

17. A roll-up door according to claim 15, wherein said first and second housings are filled with insulation material.

18. A roll-up door according to claim 15, wherein said first and second housings are provided with electrical heating means for heating said track so that said slats can freely ride up and down within said track.

19. A roll-up door according to claim 7, wherein said thermal protection means includes a hood arrangement disposed longitudinally over said support roller, said hood arrangement including electrical heating means for heating said slats.

20. A roll-up door according to claim 19, wherein said electrical heating means are disposed in a hood, hinge means pivottingly connecting said hood to a bracket member secured to a doorway wall to permit said hood to pivot relative to said support roller.

21. A roll-up door according to claim 20, wherein said electrical heating means includes an insulated electrical heating wire having a serpentine configuration to heat entire area of said hood.

22. A roll-up door according to claim 18, wherein said first gear is larger than said third gear, and said third gear is larger than said second gear.

23. A roll-up door according to claim 22, wherein shafts of said first, second and third gears are in a straight horizontal alignment with each other.

* * * * *